US006998020B2

(12) United States Patent
Rose

(10) Patent No.: US 6,998,020 B2
(45) Date of Patent: Feb. 14, 2006

(54) SCREEN AND PROCESS FOR PAPER PATTERNING

(75) Inventor: John Edward Rose, Chorley (GB)

(73) Assignee: J R Crompton Limited, Manchester (GB)

( * ) Notice: Subject to any disclaimer, the term of this patent is extended or adjusted under 35 U.S.C. 154(b) by 0 days.

(21) Appl. No.: 10/475,564

(22) PCT Filed: Apr. 12, 2002

(86) PCT No.: PCT/GB02/01720

§ 371 (c)(1),
(2), (4) Date: Apr. 8, 2004

(87) PCT Pub. No.: WO02/088464

PCT Pub. Date: Nov. 7, 2002

(65) Prior Publication Data

US 2004/0154774 A1 Aug. 12, 2004

(30) Foreign Application Priority Data

May 1, 2001 (GB) ..... 0110616
May 11, 2001 (GB) ..... 0111680

(51) Int. Cl.
*D21F 11/00* (2006.01)
*B65B 29/02* (2006.01)

(52) U.S. Cl. ..... 162/211; 162/109; 162/116; 426/77

(58) Field of Classification Search ..... 162/109, 162/117, 116, 211, 208; 426/77
See application file for complete search history.

(56) References Cited

U.S. PATENT DOCUMENTS

| | | | | | |
|---|---|---|---|---|---|
| 2,477,000 | A | * | 7/1949 | Osborne | 162/146 |
| 2,879,172 | A | * | 3/1959 | Sorg | 427/172 |
| 2,991,218 | A | * | 7/1961 | Cirrito et al. | 162/217 |
| 2,999,788 | A | * | 9/1961 | Morgan | 162/146 |
| 3,106,481 | A | * | 10/1963 | Sorg | 427/208.2 |
| 3,174,889 | A | * | 3/1965 | Anderson et al. | 156/254 |
| 3,230,136 | A | * | 1/1966 | Krake | 162/111 |
| 3,322,617 | A | * | 5/1967 | Osborne | 162/296 |
| 3,350,260 | A | * | 10/1967 | Johnson | 162/116 |
| 3,881,987 | A | * | 5/1975 | Benz | 162/116 |
| 5,503,715 | A | * | 4/1996 | Trokhan et al. | 162/296 |
| 5,527,428 | A | * | 6/1996 | Trokhan et al. | 162/116 |
| 5,654,076 | A | * | 8/1997 | Trokhan et al. | 428/131 |
| 5,804,281 | A | * | 9/1998 | Phan et al. | 428/137 |
| 5,820,730 | A | * | 10/1998 | Phan et al. | 162/112 |
| 6,136,146 | A | * | 10/2000 | Phan et al. | 162/109 |
| 6,464,831 | B1 | * | 10/2002 | Trokhan et al. | 162/134 |
| 2003/0113411 | A1 | * | 6/2003 | Rose et al. | 426/77 |
| 2004/0154774 | A1 | * | 8/2004 | Rose | 162/211 |

FOREIGN PATENT DOCUMENTS

| | | | |
|---|---|---|---|
| WO | WO 200188266 | A1 * | 11/2001 |
| WO | WO 200288464 | A1 * | 11/2002 |

* cited by examiner

*Primary Examiner*—José A. Fortuna
(74) *Attorney, Agent, or Firm*—Woodard, Emhardt, Moriarty, McNett & Henry LLP

(57) ABSTRACT

A screen (i) for use in forming a patterned paper by a wet-laying technique. The screen is of a mesh material (2) that is pervious to water and has formed therein repeats of pattern forming elements 3*a–c,* 4*a–d* and 5 which are defined by an area of at least partial blockage of the mesh and which are bounded by mesh that is not blocked to drainage. The pattern forming elements have a maximum are of 100 $mm^2$ that is blocked to drainage. The screen may be used for producing patterned tissue paper from which tea and coffee bags may be produced.

21 Claims, 3 Drawing Sheets

SCREEN AND PROCESS FOR PAPER PATTERNING

The present invention relates to a screen for use in forming a patterned paper, particularly but not exclusively a tissue for manufacture of a beverage infusion package, and also to a method of producing patterned paper.

Beverage infusion packages comprise a beverage precursor material (e.g. tea leaves or ground coffee) enclosed within a bag, pouch, sachet or the like (all conveniently referred to herein as a bag) of a paper usually having a basis weight in the range 10 to 30 $gm^{-2}$. The paper is frequently referred to as "tissue" or "tea bag tissue" and is typically formed by a conventional wet-laying technique in which an aqueous suspension of paper forming fibres is laid onto a travelling, water pervious paper-forming screen with water then being drained through the screen to produce the paper.

The tissue may be of the heat seal type which incorporates thermoplastic fibres and from which the beverage infusion bag is produced by heat sealing two layers of the tissue together. Alternatively the tissue may be of the non-heat seal type from which the closure seams(s) of the beverage infusion bag is/are produced by a mechanical, e.g. crimping, action without heat sealing.

It is often required that the tissue be produced with a pattern. Various examples of patterns are used, e.g. the initials and/or logo of the manufacturer of the beverage infusion packages. Alternatively the pattern may comprise a repeat of small circular or diamond-shaped "dots" that are intended to give the impression of perforations in the tissue.

Various methods of producing patterns in tissue are known.

One such technique is fluid jet-patterning. In this technique, the pattern is formed using fluid jets (usually water) directed at the web whilst it is still on the paper forming screen during the process of manufacture by wet-laying. In more detail, a cylindrical patterning screen rotating about a horizontal axis is provided above the paper forming screen and its wall is pierced by apertures that define the pattern to be produced. Within the cylindrical patterning screen is a source of fluid jet pressure (e.g. a water supply) which is directed radially outwardly so as to traverse the apertures in the patterning screen and issue as jets which form the pattern in the web. This technique does however have the disadvantage that there can be a reduction in the mechanical strength of the web/as compared to that obtainable without fluid jet patterning) due to disruption of the fibre structure of the web. In extreme cases the web may be ripped. Additionally the sifting characteristics of the web may be poor allowing fines of beverage precursor material to be lost from the final infusion bag. Moreover water jet patterning requires large amounts of water over and above those used for forming the wet laid suspension in the paper forming screen.

In the case of a pattern which is comprised of repeating dots (to give the impression of perforations) this may be produced by protrubences (so-called "knuckles") projecting from the paper-forming screen of a wet laid manufacturing process. The fibre density (i.e. the number of fibres per unit area) in the region of the paper formed on the knuckle is less than in the other regions thereby giving the impression of a pattern. This technique does however suffer the disadvantage that the localised open area and reduction in fibre density created by the wire knuckles causes (i) an area of mechanical weakness in the paper web at that point;

(ii) poor sifting characteristics; and (iii) poor and variable pattern definition.

Furthermore the use of "knuckles" limits the morphology of fibres that may be used due to the sheet release characteristics of the wire design. A further disadvantage is that there is only limited scope for "personalising" papers (e.g. with a particular logo or other trade mark).

Various other methods are known in which the paper forming screen is "configured" to provide desired "effects" in the finally produced paper.

Thus, for example, GB-A-1 008 703 (Crompton) discloses a method of manufacturing a heat seal tissue in which the heat seal fibres are preferentially deposited on a criss-cross network of lines along which the heat sealed seams of the final infusion bags will be formed. More particularly, GB-A-1 008 703 discloses a paper forming screen having a repeating pattern (in both the travelling direction of the screen during paper manufacture and the direction perpendicular thereto) of spaced regions (e.g. squares) that are blocked to the passage of water, e.g. by gelatin. These spaced, blocked regions define, in effect, a criss-cross arrangement of lines (by which the blocked regions are separated) and these lines are unblocked. Thus the screen comprises, in effect, a criss-cross arrangement of lines in which there is no blockage to drainage with these lines bounding the discrete blocked-off areas. As a result of this arrangement, there is preferential accumulation of fibres (including heat seal fibres) along the unblocked lines of the screen due to the fact that drainage can only occur through these areas. The criss-cross lines of the paper (which there is preferential accumulation of fibres) are used for providing the seams of beverage infusion bags whereas those regions of the paper corresponding to the blocked off areas of the screen provide the "faces" of the bags. Thus the blocked off areas of the screen typically have an area of at least 500 $mm^2$, e.g. about 625 $mm^2$.

A further type of paper-forming screen that is "configured" to provide a desired "effect" in the finally produced paper is disclosed in EP-A-0 135 231 (Procter & Gamble). The screen of this disclosure comprises a honeycomb-type frame formed on the base material of the paper forming screen, this frame providing areas of the screen that are blocked to drainage. The screen is used to produce a paper (such for paper towels or facial tissue) having surface protrubrunces formed in the open cells of the honeycomb.

It is an object of the present invention to obviate or mitigate the abovmentioned disadvantages.

According to a first aspect of the present invention there is provided a screen for use in forming a patterned paper by a wet-laying technique, the screen being of a mesh material that is pervious to water and having formed therein repeats of pattern forming elements which are defined by an area of at least partial blockage of the mesh and which are bounded by mesh that is not blocked to drainage wherein the pattern forming elements have a maximum area of 100 $mm^2$ that is blocked to drainage.

The invention also provides, in a second aspect, a method of forming a patterned paper comprising wet-laying a suspension of paper-forming fibres onto a screen as defined in the previous paragraph so as to form a web and draining water from the web to produce the patterned paper.

In the context of the present invention, a pattern forming element is an area of the mesh material which is completely bounded externally (and possibly also internally see infra by unblocked mesh and which (i.e. the pattern forming element) is at least partially blocked to drainage, provided that within the area of the pattern forming element there is no more than 100 $mm^2$ blockage of the screen. The area of the pattern forming element that is blocked to drainage is preferably a maximum of 50 $mm^2$ and may be considerably less, e.g. a maximum of 25 $mm^2$ or even a maximum of 10 $mm^2$.

When the screen is used for producing paper by a wet-laying technique, a pattern is formed in the paper due to the provision in the screen of the pattern forming elements described above. In more detail, water from the fibrous suspension of papermaking fibres laid onto the screen is only able to drain through those regions of the screen that are not blocked to drainage. As a result, there is in the final paper a higher fibre concentration in those areas of the paper corresponding with unblocked areas of the screen as compared to the blocked areas. Since the area of the pattern forming element is at least partially blocked to drainage there is a lower fibre concentration in the areas of the paper corresponding to the pattern forming elements than in the areas between these elements. This lower concentration of fibres gives a visually discernible pattern (corresponding with the original pattern forming elements) in the final paper.

As indicated, individual pattern forming elements are bounded by unblocked mesh. This will be an unblocked area of the mesh surrounding the outer boundary of the element so that individual pattern forming elements will be separated from each other by an area of the screen where there is no blockage to drainage. It should also be understood that a pattern forming element can also be bounded internally by an area of the screen that is unblocked to drainage. The boundary (inner or outer) of the character that is unblocked to drainage will generally comprise at least one line of apertures of the mesh that are totally unblocked to drainage. Thus, at a minimum, there will generally be a single line of (totally) unblocked apertures that may be traced between two adjacent pattern forming elements. Generally the boundary between two adjacent pattern defining elements will comprise (in going from one pattern forming element to the adjacent element) a plurality of apertures of the mesh that are totally unblocked to drainage.

On the basis of the definitions given in the previous paragraph the following examples illustrate what is intended by the term "pattern forming element".

(a) The letter "I" in which the "bars" and the "stem" of the latter are defined by a "connected" area of mesh that is blocked to drainage is one pattern forming element;

(b) The letter "i" in which the "stem" and the "dot" are separate areas of mesh that are blocked to drainage comprises two pattern forming elements even though it is regarded as a single character.

(c) The letter "T" in which the "bar" and the "stem" are areas of the mesh at least partially blocked to drainage but with a slight separation between the "bar" and "stem" is regarded as two pattern defining elements. The extent to which the "bar" and "stem" are separated could be relatively small so that in the final patterned paper the separation is not noticed with normal vision.

(d) The letter "O" in which the outline of the letter (i.e. the "circular line") would be regarded as one pattern defining element (because the "circular line" is bounded both internally and externally by unblocked regions of the mesh)

(e) Following on from (d), a "motif" comprised of, say, a letter within a circular (or oval, elliptical etc) boundary comprises two pattern forming elements, i.e. the letter and the circular boundary.

The use of pattern forming elements in which the area that is blocked to drainage does not exceed 100 $mm^2$ ensures that the individual patterns in the web do not provided any significant weakness therefor.

The pattern forming elements may be of any desired visual appearance and may for example, be letters of the alphabet or alternatively may be pictorial. It is possible for the pattern forming elements as defined above to be combined with non-blocked areas of the web so that it is the combination which gives rise to a recognisable pattern. Thus consider for example the letter "O". In this case, the pattern forming element will be formed by blockage of the screen to define the outline of the letter whereas the centre of the letter will be provided by an unblocked region of the screen.

The pattern forming elements are formed by at least partial blockage of the apertures of the mesh in the area of the pattern forming element. The pattern forming elements may for example be defined by areas of complete blockage of the web to drainage. Alternatively the pattern forming elements may incorporate areas where there is no blockage to drainage. Such unblocked areas may comprise one or more full apertures of the mesh that is/are unblocked to drainage. Several such unblocked full apertures of the mesh maybe juxtaposed to each other. Alternatively or additionally unblocked areas of the pattern forming elements may be formed by incomplete blockage of individual apertures of the mesh. Several such partially blocked apertures may be provided adjacent to each other so that their individual unblocked areas lie within the boundary of a larger unblocked area.

Within any one pattern forming element there may be several discontinuous areas that are unblocked to drainage.

It is preferred that a minority of the area of the pattern forming element is open to drainage. This ensures sufficient fibre concentration within the bounds of the pattern to ensure integrity of the web. Generally there will be at least 60% blockage in this area, more preferably at least 80%. The blockage may for example be 90%–100% of the area of the pattern forming element.

The screen in accordance with the invention will generally be in the form of an endless belt.

The individual pattern forming elements will generally be repeated in both the longitudinal transverse directions of the screen.

It is preferred that the material used for effecting blockage of base material does not project out of the plane of the base material.

As indicated above, the base material of the paper screen is a mesh-like structure, most preferably one formed from synthetic monofilaments. Ideally the diameter of the fibres forming the mesh is in the range 0.15–0.30 mm. Preferably also the mesh comprises 32 filaments per centimetre in the machine direction and 30 filaments per centimetre in the cross direction. A suitable mesh material is available from Albany International under the trade name of MONTOTEX K3.

Blockage of the base material to drainage may be provided by applying a synthetic resin to block apertures of the mesh so that the desired repeat of pattern forming elements is produced. Conveniently the resin may be applied by a printing technique such a screen printing, gravure printing, blanket offset printing. A further possibility is the use of photoresist technology in which a negative of the desired formation of pattern forming elements is juxtaposed to the base screen material impregnated with curable resin. Light (e.g. uv radiation) is then used to cure those regions of the resin on the screen corresponding to the pattern forming elements and uncured resin removed to leave the final screen. Other techniques that can be used include transfer coating.

The polymer used for effecting blockage of the apertures should be compatible with the base material of the screen and may for example be a film forming polymeric resin. Examples of suitable resins include polyamides and polyurethanes.

Paper forming screens as described above may be used for producing tissue, for beverage infusion bags, by standard wet-laying techniques, e.g. using an inclined wire paper making machine. The material produced may be of the heat seal or non-heat seal type and may for example have a basis weight of 10 to 30 $gm^{-2}$, e.g. 10 to 20 $gm^{-2}$. In papers produced (in accordance with the invention) for beverage infusion bags the spacings between the repeats of the patterns will generally be such that there are a number of repeats of the pattern on each "face" of the beverage infusion bag.

Typically the fibres used in this paper making process will have a length of 3 to 5 mm and may comprise only cellulose fibres (for a non-heat seal material) or a blend of cellulose and thermoplastic fibres for a heat seal material.

Tissues produced with the paper making screen of the invention have a number of advantages compared with those produced by fluid jet patterning. In particular, tissues produced in accordance with the invention have good mechanical properties (since there has been no disruption of the fibres by a patterning jet). The improved strength is an advantage for resisting tearing of the web by deckle edge sprays and also for conversion of the web into beverage infusion packages on standard conversion machinery. Furthermore the papers have better sifting properties. A further advantage lies in the fact that production speed of the paper web is not limited by the speed by which the fluid patterning arrangement may be operated.

Similar advantages apply to the present invention as compared to the use of "knuckles" for forming a pattern in the paper. Moreover, as compared to the use of "knuckles", the present invention allows complete flexibility of the choice of the pattern forming elements and the invention is not confined to the use of fibres of a particular morphology.

Tissues produced in accordance with the invention may be produced on standard conversion machinery to produce (beverage infusion bags).

The invention will now be described, by way of example only, with reference to accompanying drawings, in which.

Figure 1:
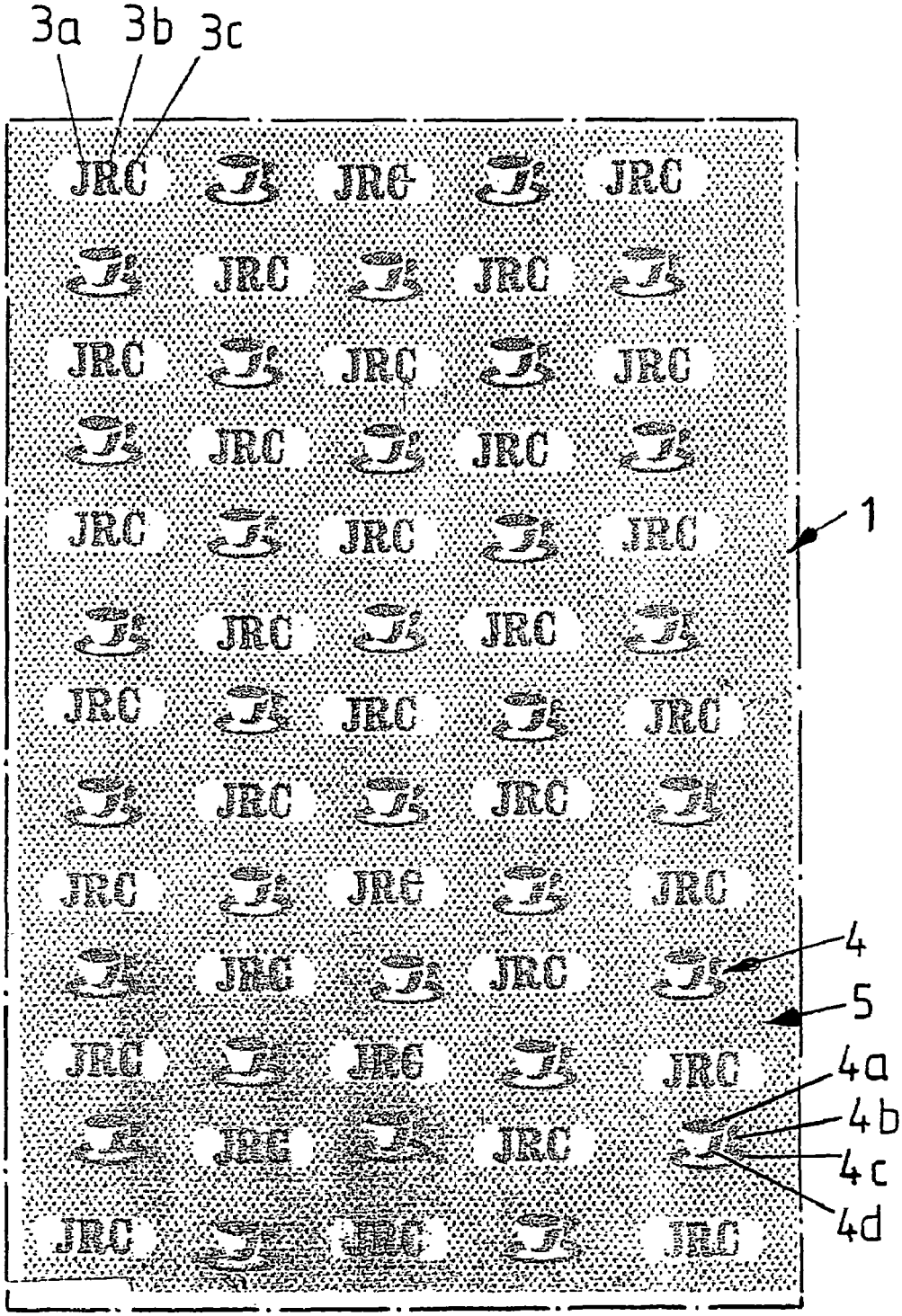
FIG. 1 illustrates one embodiment of paper-forming screen in accordance with the invention.

Referring to FIG. 1, there is illustrated a portion of a screen 1 in accordance with the invention for use in forming, by a conventional wet-laying technique, a patterned tissue for the production of beverage infusion bags such as teabags or coffee-bags. The screen 1 is formed of a water pervious base material 2 (described below with reference to FIG. 2) in which regions thereof have been at least partially blocked, in the manner described more fully below, to the passage of water so as to define repeats of pattern forming elements. For convenience, the at least partially blocked regions are depicted in FIG. 1 by dark coloration and unblocked areas of the base material 2 are depicted as white.

Various types of pattern forming element are shown in FIG. 1 with each type repeating in two perpendicular directions, i.e. along the length and across the width of the screen. The repeating pattern forming elements are as follows:

(a) three pattern forming elements 3*a*, 3*b*, 3*c* comprised of the letters J, R and C on a "lozenge-shaped" background, each of the letters J, R and C respectively being defined by partially blocked regions of the base material and the "lozenge-shaped" being defined by an unblocked region;

(b) pattern forming elements 4*a*, 4*b*, 4*c* and 4*d* which together define a representation of a cup and saucer; and (c) pattern forming elements 5 comprised of small diamonds (represented in FIG. 1 by the black, diamond shaped dots).

Each of the pattern forming elements 3*a–c*, 4*a–d* and 5 has an area of less than 100 $mm^2$.

Figure 2:
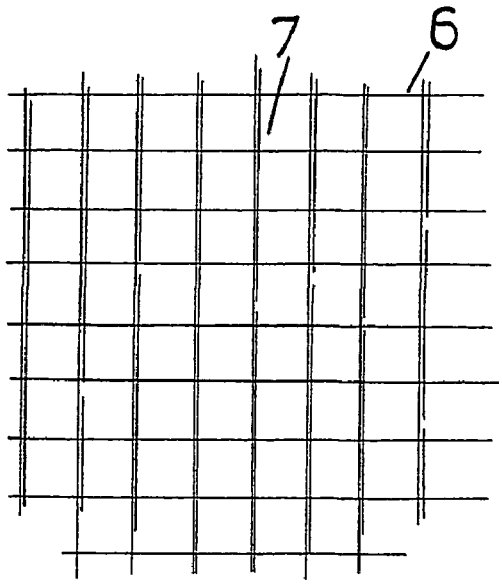
FIG. 2 illustrates, to a much enlarged scale, the base material from which the screen illustrated in FIG. 1 is produced.

The base material 2 is shown to a much enlarged scale in FIG. 2 and is of a mesh-like structure comprised of synthetic plastics monofilaments 6 arranged to define apertures 7 whereby material 2 is water pervious. It should be appreciated that those areas of the screen 1 which are shown in FIG. 1 as white (to represent unblocked areas) are of the open mesh structure shown in FIG. 2.

The manner in which various pattern forming elements are formed is by blockage or partial blockage (to the passage of water) of apertures 7 in various regions of the material 2 as will now be explained with reference to FIG. 3.

Figure 3:
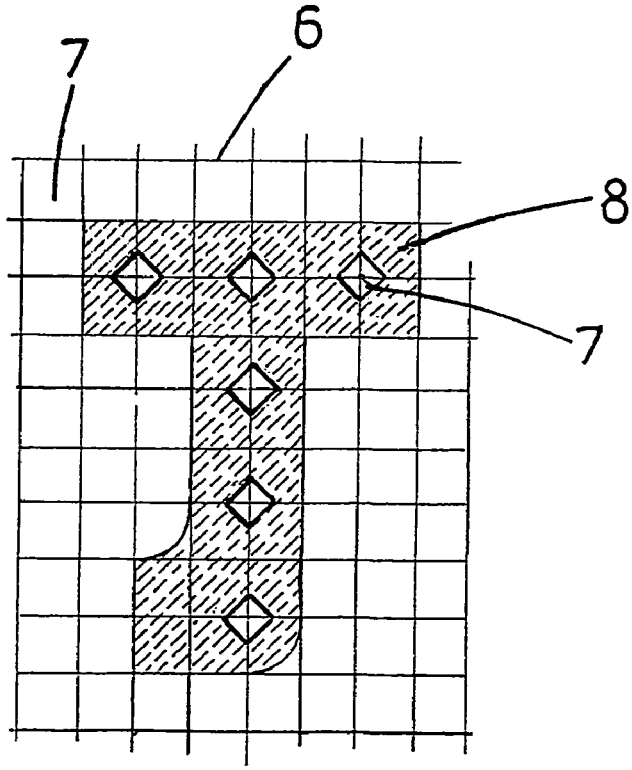
FIG. 3 illustrates the manner in which a pattern is provided in the base material of FIG. 2 to produce a screen as shown in FIG. 1.

FIG. 3 shows the manner in which the letter "J" is formed for the patterning of the screen. More particularly, for each repeating "J" there is a "J-shaped" region in which certain of the original apertures 7 within the bounds of the "J" are blocked to an extent of 75% by a polymer 8. More particularly, unblocked areas of four apertures 7 are arranged in groups so as to define a larger diamond-shaped unblocked areas of the mesh. Furthermore, as seen in FIG. 3, the unblocked diamond-shaped areas are arranged such that the "bar" and "vertical stem" of the letter "J" incorporates several such diamond-shaped areas where there is no blockage (of the mesh) to drainage.

The letter "C" of the letter set "JRC" may be constructed in like manner as also may be the letter "R" although in the latter case it should be noted that the area of the "loop" of the letter is unblocked to drainage so as to give the required overall appearance.

Each "cup and saucer" design is made up of four pattern forming elements 4*a*, 4*b*, 4*c* and 4*d* each of which is bounded by an unblocked region of the screen and which together with unblocked regions of the mesh give the overall appearance of a cup-and-saucer. Each of the elements 4*a–d* may be formed in a similar manner to the letter "J" as described above.

The diamonds 5 may be constructed in like manner to the letter "J".

The screen 1 may be produced, for example, by a printing technique which lays down onto the base material 2 the areas of polymer (e.g. as represented by reference numeral 8 for the letter "J") which provide for at least partial blockage of the apertures 7 thereby defining the pattern forming elements 3*a–c*, 4*a–d* and 5. Examples of printing techniques that can be used include screen printing, gravure printing, blanket offset printing. Transfer coating may also be used.

Alternatively the screen 1 (with its areas of cured resin) may be produced using photoresist technology. Thus, for example, the base material 2 may be coated with a resin (e.g. curable by ultraviolet light) and juxtaposed to a negative of the arrangement of blocked and/or partially blocked apertures to be provided in the final screen. The assembly of negative and resin coated base material 2 is then irradiated so as to cure the resin in those areas of the base material which are to be blocked or partially blocked. Subsequently uncured resin is removed to leave the final screen. It is preferred, but not essential, that the curable resin system is one which is such that the uncured areas may be removed by water.

Figure 4:
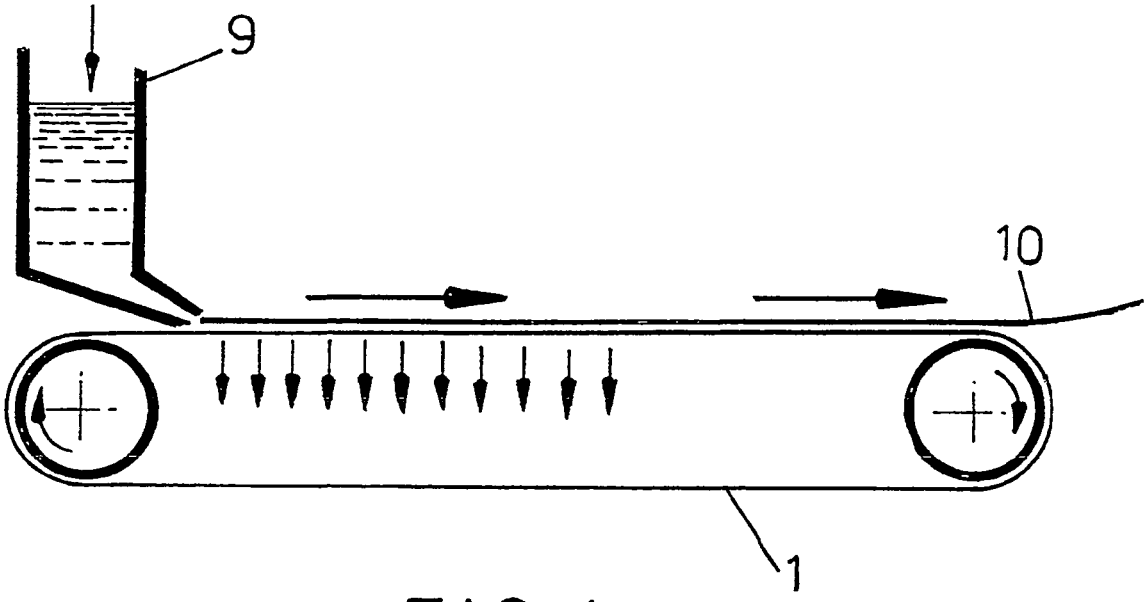
FIG. 4 illustrates the production of paper.

As indicated above, the screen 1 is intended for use in producing paper by a wet-laying technique. Such a technique is illustrated schematically in FIG. 4 from which it will be seen that the screen 1 is provided as an endless belt onto which is deposited an aqueous suspension of paper-forming fibres from a headbox 9. As the laid suspension is carried along by the screen, water is drained through the screen (e.g. with the aid of vacuum boxes) so as to form the paper web 10 which is subsequently removed for drying and reeling operations, all of which are entirely conventional. Although not specifically illustrated in FIG. 4, the endless belt may be of the "inclined wire" type.

The final web 10 carries a pattern corresponding to that on the screen 1. The formation of this pattern results from the drainage characteristics of the screen 1. More particularly, during drainage of the laid suspension, a greater "concentration" of fibres accumulates in those areas of the screen that are not obscured by resin than in those areas which are so obscured. The visible pattern on the final web is therefore due to differential amounts of fibres in the web as between those areas laid on blocked and unblocked regions of the screen. Consequently the final has a pattern corresponding to that of the screen 1. Thus for the illustrated embodiment the paper web 10 incorporates repeats of the letter set JRC on a lozenge-shaped background and repeats of the cup and saucer. There are also repeats of the diamond shape and in the final paper web 1 these give the impression of perforations in the paper.

What is claimed is:

1. A method of forming a patterned tissue paper having a basis weight of 10 to 30 g $m^{-2}$ on an inclined wire paper making machine comprising wet-laying a suspension of appear-forming fibres onto the inclined screen that is pervious to water to form a web and draining water from the web to produce the patterned paper wherein the screen is of a mesh material that is pervious to water and has formed therein repeats of pattern forming elements which are defined by an area of blockage of the mesh by a material that does not project out of the plane of the mesh material and which are bounded by mesh that is not blocked to drainage wherein the pattern forming elements have a maximum area of 50 $mm^2$ that is blocked to drainage and the pattern forming elements incorporate areas where there is no blockage of the web to drainage.

2. A method as claimed in claim 1 wherein the pattern forming elements have a maximum area of 25 $mm^2$ blocked to drainage.

3. A method as claimed in claim 2 wherein the pattern forming elements have a maximum area of 10 $mm^2$ blocked to drainage.

4. A method as claimed in claim 1 wherein pattern forming elements have at least 60% of their area blocked to drainage.

5. A method as claimed in claim 4 wherein pattern forming elements have at least 80% of their area blocked to drainage and the remaining area of the elements open to drainage.

6. A method as claimed in claim 1 wherein the unblocked areas incorporated in the pattern forming element comprise one or more full apertures of the mesh that is/are unblocked to drainage.

7. A method as claimed in claim 6 wherein a plurality of such unblocked full apertures of the mesh are juxtaposed to each other.

8. A method as claimed in claim 1 wherein unblocked areas of the pattern forming elements are formed by incomplete blockage of individual apertures of the mesh.

9. A method as claimed in claim 8 wherein a plurality of such partially blocked apertures are provided adjacent to each other so that their individual unblocked areas lie within the boundary of a larger unblocked area.

10. A method as claimed in claim 1 wherein at least some of the pattern forming elements are letters of the alphabet.

11. A method as claimed in claim 1 wherein at least some of the pattern forming elements are pictorial.

12. A method as claimed in claim 1 wherein the pattern forming elements are formed by at least partial blockage of apertures of the mesh by means of a polymeric material.

13. A method as claimed in claim 12 wherein the polymeric material has been applied by a printing technique.

14. A method as claimed in claim 13 wherein the polymeric material blocking the apertures of the mesh comprises a polyamide or polyurethane.

15. A method as claimed in claim 12 wherein the polymeric material has been applied by a photoresist technique.

16. A method as claimed in claim 15 wherein the polymeric material blocking the apertures of the mesh comprises a polyamide or polyurethane.

17. A method as claimed in claim 1 wherein the tissue has a basis weight of 10 to 20 g $m^{-2}$.

18. A method as claimed in claim 1 wherein the tissue is in the form of a heat sealable material.

19. A beverage infusion package formed of the paper produced by the method as claimed in claim 18.

20. A method as claimed in claim 1 wherein the tissue is in the form of a non-heat sealable material.

21. A beverage infusion package formed of the paper produced by the method as claimed in claim 20.

* * * * *